US010687627B1

(12) United States Patent
Walsh, Jr. et al.

(10) Patent No.: US 10,687,627 B1
(45) Date of Patent: Jun. 23, 2020

(54) ANTI-CLOSURE DEVICE FOR SELF FOLDING SEATS

(71) Applicants: Quentin Walsh, Jr., Fort Mill, SC (US); Tara Walsh, Fort Mill, SC (US)

(72) Inventors: Quentin Walsh, Jr., Fort Mill, SC (US); Tara Walsh, Fort Mill, SC (US)

( * ) Notice: Subject to any disclaimer, the term of this patent is extended or adjusted under 35 U.S.C. 154(b) by 18 days.

(21) Appl. No.: 16/040,664

(22) Filed: Jul. 20, 2018

Related U.S. Application Data

(63) Continuation of application No. 15/971,589, filed on May 4, 2018, now abandoned.

(60) Provisional application No. 62/501,714, filed on May 4, 2017.

(51) Int. Cl.
*A47C 7/60* (2006.01)
*A47C 1/121* (2006.01)

(52) U.S. Cl.
CPC ..... *A47C 7/60* (2013.01); *A47C 1/121* (2013.01)

(58) Field of Classification Search
CPC .. A47C 7/60; A47C 7/56; A47C 1/121; A47C 1/124
See application file for complete search history.

(56) References Cited

U.S. PATENT DOCUMENTS 5,839,785 A * 11/1998 Miller ..... A47C 1/121 297/411.2

* cited by examiner

*Primary Examiner* — David R Dunn
*Assistant Examiner* — Tania Abraham
(74) *Attorney, Agent, or Firm* — Tillman Wright, PLLC; James D. Wright; David R. Higgins

(57) ABSTRACT

An anti-closure device for use with a self-folding seat, including a seat portion and a tensioning system. The seat portion includes a first anchor that is adapted to be removably coupled to a seat of a self-folding seat, a second anchor that affixes to the seatback of the self folding seat or the seat portion of the adjacent seat, and the tensioning system is attached at a first end to the first anchor and at a second end to the second anchor. When installed on a self-folding seat, the tensioning system maintains force against a natural bias of the seat of the self-folding seat to fold closed, thereby holding the seat in an open state.

18 Claims, 18 Drawing Sheets

ANTI-CLOSURE DEVICE FOR SELF FOLDING SEATS

CROSS-REFERENCE TO RELATED APPLICATION

The present application is a U.S. continuation patent application of, and claims priority under 35 U.S.C. § 120 to, U.S. nonprovisional patent application Ser. No. 15/971,589, filed May 4, 2018, which patent application is a U.S. nonprovisional patent application of, and claims priority under 35 U.S.C. § 119(e) to, U.S. provisional patent application Ser. No. 62/501,714, filed May 4, 2017. The foregoing provisional and nonprovisional patent applications are incorporated by reference herein.

COPYRIGHT STATEMENT

All of the material in this patent document is subject to copyright protection under the copyright laws of the United States and other countries. The copyright owner has no objection to the facsimile reproduction by anyone of the patent document or the patent disclosure, as it appears in official governmental records but, otherwise, all other copyright rights whatsoever are reserved.

BACKGROUND OF THE PRESENT INVENTION

Field of the Present Invention

The present invention relates generally to seating in public entertainment venues, and more particularly to anti-closure devices for use with self-folding seats commonly installed in public entertainment venues such as stadiums, auditoriums and arenas.

Background

Seats in public entertainment venues like stadiums, arenas, concert halls, and the like commonly utilize a seat bottom that is designed to automatically store itself by returning to a folded configuration when not in use. Unfortunately, the seats can also close themselves when in use. This typically happens when the seats are being used to hold personal items, small children, or the like because the weight of the items or children is not sufficient to hold the seat bottom down or shifts in such a way that the weight is no longer applied. This automatic folding can be frustrating and sometimes unsafe. Thus, a need exists for a simple device that prevents unwanted folding/closing of such seats. It may be additionally beneficial for the device to allow expedient re-folding of the seat when necessary such as the child and guardian leaving their seats or in the event of evacuation.

SUMMARY OF THE PRESENT INVENTION

Some exemplary embodiments of the present invention may overcome one or more of the above disadvantages and other disadvantages not described above, but the present invention is not required to overcome any particular disadvantage described above, and some exemplary embodiments of the present invention may not overcome any of the disadvantages described above.

Broadly defined, the present invention according to one aspect relates to an anti-closure device for use with a self-folding seat. An exemplary device includes: a seat portion, including a first anchor that is adapted to be removably coupled to a seat bottom of a self-folding seat; a seatback portion, including a second anchor that is adapted to be removably coupled to a seatback of the self-folding seat; and a tensioning system attached at a first end to the first anchor and at a second end to the second anchor; wherein, when installed on the self-folding seat, the tensioning system maintains force against a natural bias of the seat bottom of the self-folding seat to fold closed, thereby holding the seat bottom in an open state.

In a variation of this aspect, the first and second anchors are hooks.

In another variation of this aspect, the first and second anchors are pockets of fabric.

In another variation of this aspect, the tensioning system includes a strap. In a further variation, the strap includes a buckle.

In another variation of this aspect, the tensioning system includes a rope.

In another variation of this aspect, the tensioning system includes a band.

In another variation of this aspect, the tensioning system includes a third anchor that is adapted to be removably coupled to a middle of the self-folding seat.

In another variation of this aspect, the size of the seat portion can be adjusted to accommodate different sizes of self-folding seats.

In another variation of this aspect, the size of the seatback portion can be adjusted to accommodate different sizes of self-folding seats Broadly defined, the present invention according to another aspect relates to an anti-closure device for use with self-folding seats. An exemplary device includes: a first attachment portion that is adapted to be removably coupled to a first seat bottom of a first self-folding seat; a second attachment portion that is adapted to be removably coupled to a second seat bottom of a second self-folding seat, the second seat being adjacent to the first; and a tensioning system attached at a first end to the first attachment portion and at a second end to the second attachment portion; wherein, when installed on the first and second self-folding seats, the tensioning system maintains force against a natural bias of the seat bottom of the first self-folding seat to fold closed, thereby holding the first seat bottom in an open state.

Broadly defined, the present invention according to another aspect relates to an anti-closure device for use with self-folding seats. An exemplary device includes: a first attachment portion that is adapted to be removably coupled to a first seat bottom of a first self-folding seat; a second attachment portion that is adapted to be removably coupled to a second seat bottom of a second self-folding seat, the second seat being adjacent to the first; and a linkage, connected between the first and second attachment portions to connect the first seat bottom to the second seat bottom; wherein, when installed on the first and second self-folding seats, force produced by the weight of a person seated in the second seat bottom is transferred to the first seat bottom and maintained against a natural bias of the seat of the first self-folding seat bottom to fold closed, thereby holding the first seat bottom in an open state.

In a variation of this aspect, the first and second seat bottoms are connected by a strap or rope that wraps around a front of the first or second self-folding seat.

In another variation of this aspect, the first and second seat bottoms are connected by permanently affixing connectors to respective undersides of the first and second seat bottoms and bridging those connectors with a rigid member.

In another variation of this aspect, the linkage includes a rigid member, wherein the second attachment portion includes a clamp that is removably coupled to the second seat bottom, and wherein the first attachment portion includes a strap or rope connected to the first self-folding seat and/or a seat cover on the first self-folding seat.

In another variation of this aspect, the linkage includes a rigid member, wherein the first and second attachment portions each include a suction cup, and wherein the suctions cups are each removably coupled to an underside of a respective seat bottom.

In another variation of this aspect, the linkage includes a rigid member, wherein the first and second attachment portions each include a magnet, and wherein the magnets are each removably coupled to a respective seat bottom.

In another variation of this aspect, the first and second seat bottoms are connected by a strap or rope, and wherein the device further includes a counterweight hanging from the strap or rope.

In another variation of this aspect, the first and second seat bottoms are connected by one or more spring-loaded camming devices.

In another variation of this aspect, the self-folding seats include a structural member interposed therebetween, the linkage includes a rigid member, and the rigid member is nonlinear so as to fit around the structural member.

Further areas of applicability of the present invention will become apparent from the detailed description provided hereinafter. It should be understood that the detailed description and specific examples, while indicating preferred embodiment(s) of the invention, are intended for purposes of illustration only and are not intended to limit the scope of the invention.

BRIEF DESCRIPTION OF THE DRAWINGS

Further features, embodiments, and advantages of the present invention will become apparent from the following detailed description with reference to the drawings, wherein.

DETAILED DESCRIPTION

Figure 1A:
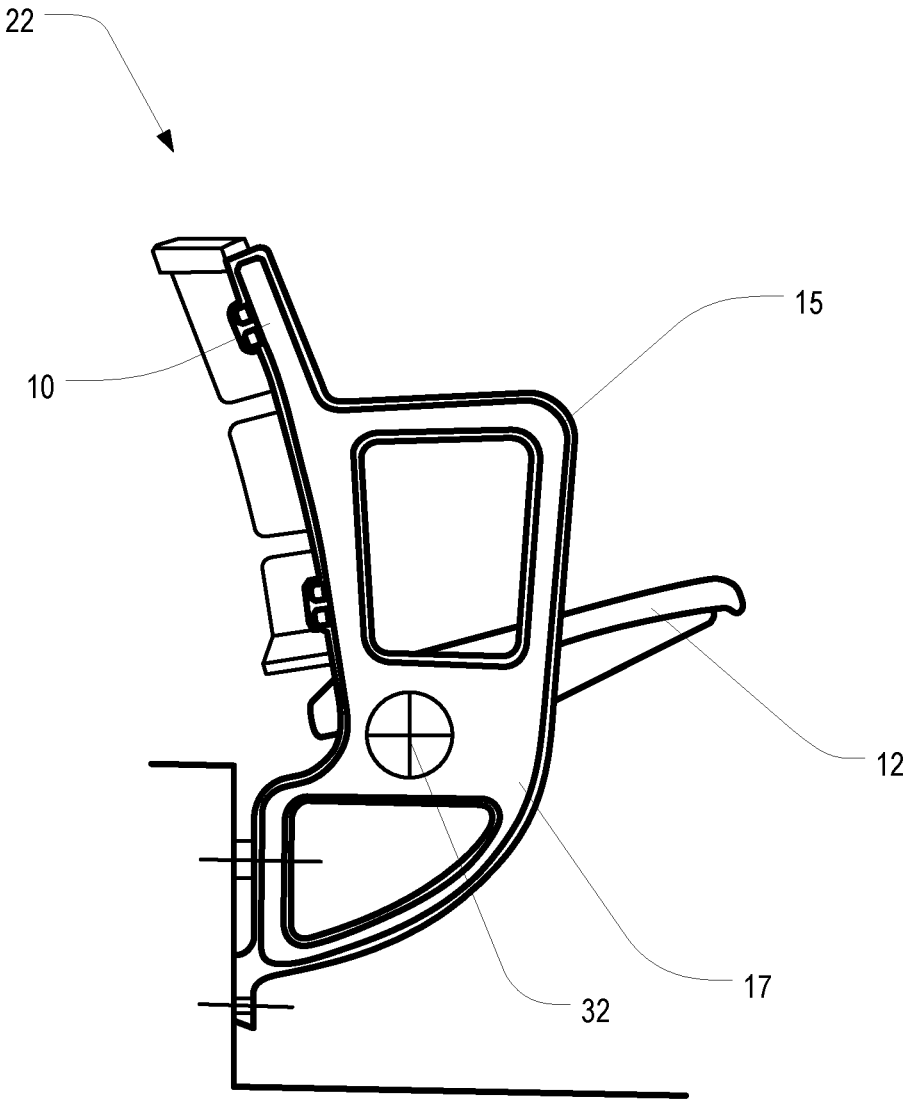
FIGS. 1A and 1B are side views of a conventional self-folding seat.

As a preliminary matter, it will readily be understood by one having ordinary skill in the relevant art ("Ordinary Artisan") that the present invention has broad utility and application. Furthermore, any embodiment discussed and identified as being "preferred" is considered to be part of a best mode contemplated for carrying out the present invention. Other embodiments also may be discussed for additional illustrative purposes in providing a full and enabling disclosure of the present invention. Furthermore, an embodiment of the invention may incorporate only one or a plurality of the aspects of the invention disclosed herein; only one or a plurality of the features disclosed herein; or combination thereof. Moreover, many embodiments, including adaptations, variations, modifications, and equivalent arrangements, are implicitly disclosed herein and fall within the scope of the present invention.

Accordingly, while the present invention is described herein in detail in relation to one or more embodiments, it is to be understood that this disclosure is illustrative and exemplary of the present invention, and is made merely for the purposes of providing a full and enabling disclosure of the present invention. The detailed disclosure herein of one or more embodiments is not intended, nor is to be construed, to limit the scope of patent protection afforded the present invention in any claim of a patent issuing here from, which scope is to be defined by the claims and the equivalents thereof. It is not intended that the scope of patent protection afforded the present invention be defined by reading into any claim a limitation found herein that does not explicitly appear in the claim itself.

Thus, for example, any sequence(s) and/or temporal order of steps of various processes or methods that are described herein are illustrative and not restrictive. Accordingly, it should be understood that, although steps of various processes or methods may be shown and described as being in a sequence or temporal order, the steps of any such processes or methods are not limited to being carried out in any particular sequence or order, absent an indication otherwise. Indeed, the steps in such processes or methods generally may be carried out in various different sequences and orders while still falling within the scope of the present invention. Accordingly, it is intended that the scope of patent protection afforded the present invention is to be defined by the issued claim(s) rather than the description set forth herein.

Additionally, it is important to note that each term used herein refers to that which the Ordinary Artisan would understand such term to mean based on the contextual use of such term herein. To the extent that the meaning of a term used herein—as understood by the Ordinary Artisan based on the contextual use of such term—differs in any way from any particular dictionary definition of such term, it is intended that the meaning of the term as understood by the Ordinary Artisan should prevail.

With regard solely to construction of any claim with respect to the United States, no claim element is to be interpreted under 35 U.S.C. 112(f) unless the explicit phrase "means for" or "step for" is actually used in such claim element, whereupon this statutory provision is intended to and should apply in the interpretation of such claim element. With regard to any method claim including a condition precedent step, such method requires the condition precedent to be met and the step to be performed at least once during performance of the claimed method.

Furthermore, it is important to note that, as used herein, "a" and "an" each generally denotes "at least one," but does not exclude a plurality unless the contextual use dictates otherwise. Thus, reference to "a picnic basket having an apple" describes "a picnic basket having at least one apple" as well as "a picnic basket having apples." In contrast, reference to "a picnic basket having a single apple" describes "a picnic basket having only one apple."

When used herein to join a list of items, "or" denotes "at least one of the items," but does not exclude a plurality of items of the list. Thus, reference to "a picnic basket having cheese or crackers" describes "a picnic basket having cheese without crackers," "a picnic basket having crackers without cheese," and "a picnic basket having both cheese and crackers." Further, when used herein to join a list of items, "and" denotes "all of the items of the list." Thus, reference to "a picnic basket having cheese and crackers" describes "a picnic basket having cheese, wherein the picnic basket further has crackers," as well as describes "a picnic basket having crackers, wherein the picnic basket further has cheese."

Referring now to the drawings, in which like numerals represent like components throughout the several views, one or more preferred embodiments of the present invention are next described. The following description of one or more preferred embodiment(s) is merely exemplary in nature and is in no way intended to limit the invention, its application, or uses.

Figure 1B:
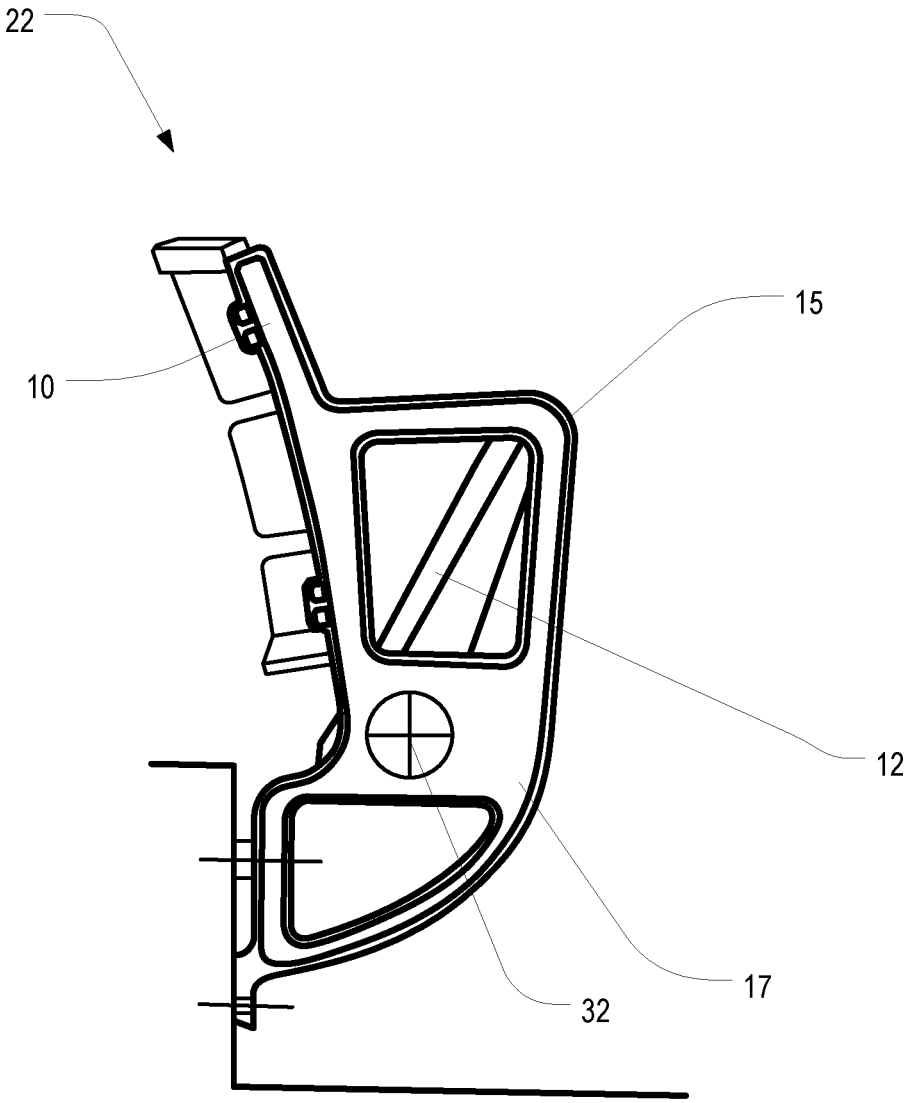

FIGS. 1A and 1B are side views of a conventional self-folding seat 22. Seats of this general design can be found at many entertainment venues. The seat is designed with a seat bottom 12 and seat back 10 that are coupled at an axis 32. The seat bottom 12 and seat back 10 are commonly supported between two side platforms 17 topped by armrests 15, as shown, but may be supported on a center platform, via rear supports, or the like (not illustrated). The back is fixed and the bottom rotates about the axis to at times a folded configuration, as shown in FIG. 1B, or an open configuration for use, as shown in FIG. 1A. A torsion spring is commonly used to return the seat to the folded configuration when not in use. Such seats are commonly found in sports stadiums, arenas, and other sporting venues; in indoor and outdoor concert and other performance venues; and in various other venues.

Figure 2:
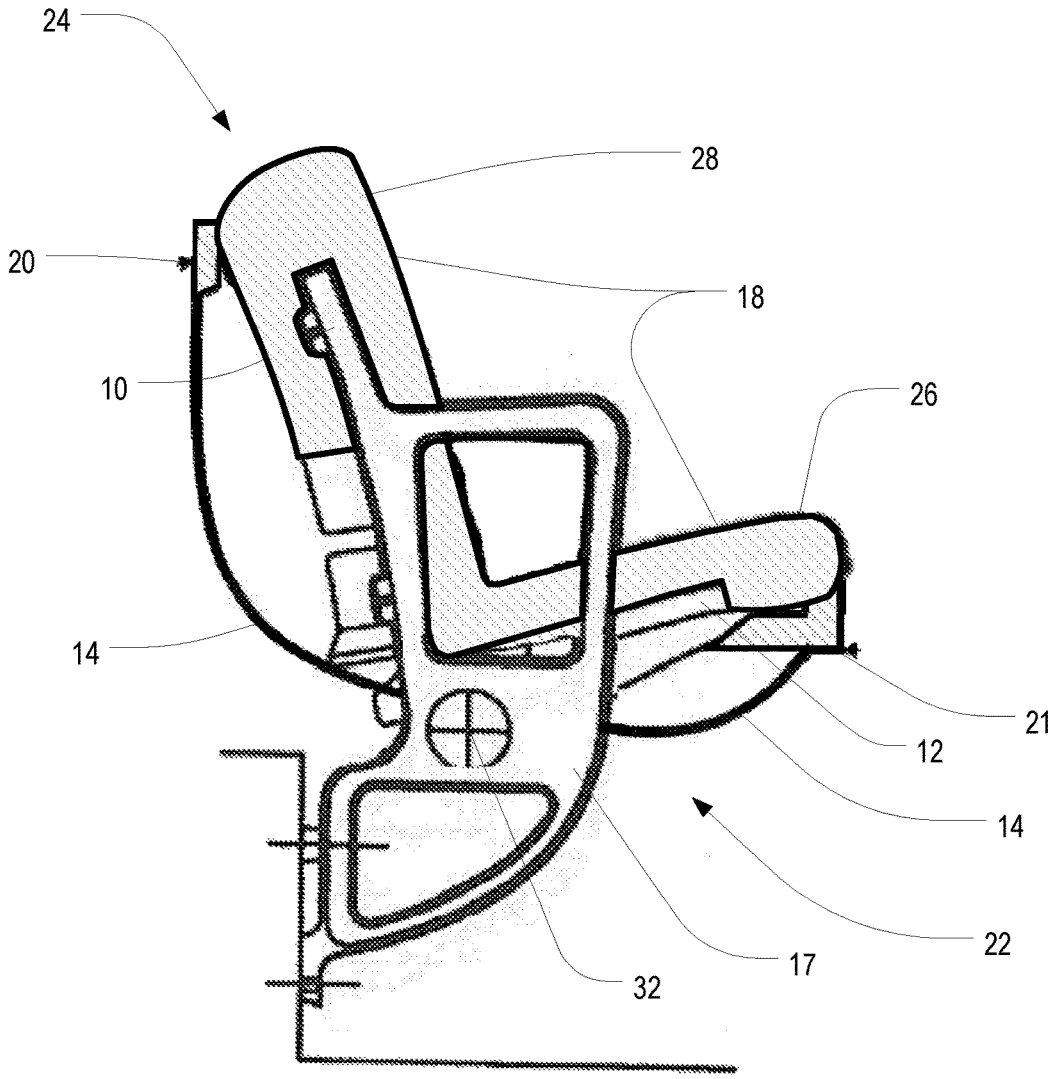
FIG. 2 is a side view of a first anti-closure device installed in the self-folding seat of FIGS. 1A and 1B in accordance with one or more preferred embodiments of the present invention.
Figure 3:
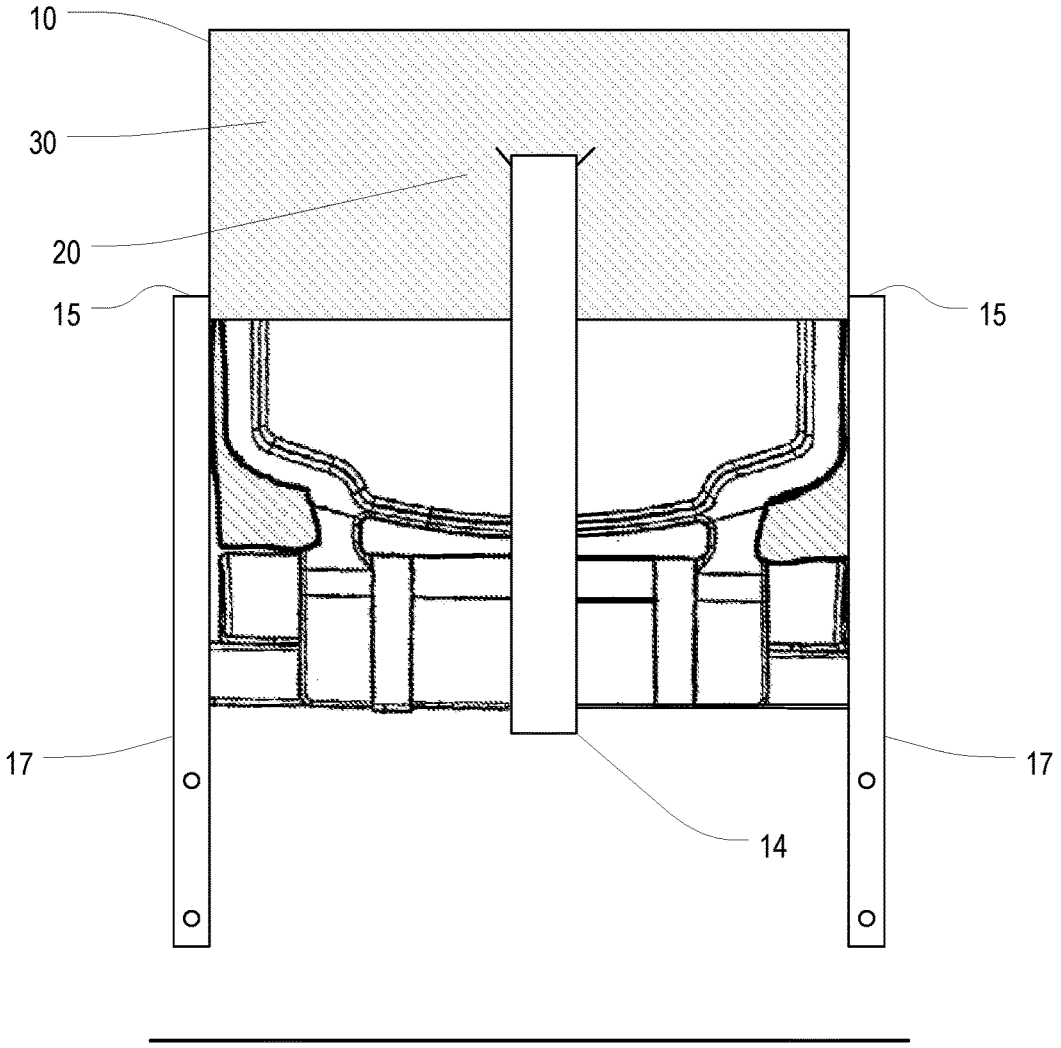
FIG. 3 is a rear view of the anti-closure device and self-folding seat of FIG. 2.

Various devices may be used to maintain the seat bottom 12 in an open or unfolded use configuration. In some approaches, such a device anchors the seat bottom 12 to the seat back 10 to keep the seat bottom 12 from springing closed. In this regard, FIG. 2 is a side view of a first anti-closure device 24 installed in the self-folding seat 22 of FIGS. 1A and 1B in accordance with one or more preferred embodiments of the present invention, and FIG. 3 is a rear view of the anti-closure device 24 and self-folding seat 22 of FIG. 2. As shown therein, the anti-closure device 24 includes a seat cover 18, top and bottom anchors 20,21, and a tensioning system 14. The seat cover 18 includes a seat portion 26 and a seatback portion 28. The seat cover 18 is preferably made of materials selected for comfort and durability such that the seat portion 26 and the seatback portion 28 conform to fit with many common self-folding seats. In many embodiments, the seat cover 18 may look like a conventional seat cover.

In some embodiments, the top and bottom anchors 20,21 each comprise a pocket arranged to fit over a respective portion of the seat 22, wherein the seat portion pocket fits over the front end of the seat 12 and the seatback portion pocket 30 fits over the top of the seatback 10. In some of these embodiments, the pockets are made of the same material used for the seat portion 26 and the seatback portion 28, but in other embodiments other materials may be used. Furthermore, other mechanisms may additionally or alternatively be utilized as anchors 20,21 to hold the seat portion 26 and seatback portion 28 on the seat 12 and seatback 10, respectively. Such mechanism may include, without limitations, hooks, bands, snaps, zippers, and the like.

The tensioning system 14 is affixed at opposite ends to the seat portion 26 and the seatback portion 28. In at least some embodiments, the tensioning system 14 includes one or more nylon straps sewn securely to the back of the seat pockets 30. A buckle may be provided to facilitate installation. However, in other embodiments, clips, hook and loop and other methods may be used to connect the seat 26 to the seat back 28 with the tensioning system 14. Regardless of the tensioning system 14 used, the end of the tensioning system 14 that is attached to the seat portion 26 is preferably attached, or applies force, at a point or points that are relatively distant from the hinge point of the seat 32 so as to maximize the moment of force being applied by the tensioning system 14.

In use, the user installs the seat portion 26 and the seatback portion 28 over the seat 12 and seatback 12 using the top and bottom anchors 20. The user would then tighten the tensioning system 14, thereby applying tension from a point or points near the front end of the seat 12 around beneath the bottom of the seatback and/or hinge point 32 to the seatback 10 portion. The top anchor 20 is thus used with the tensioning system 14 to maintain force against the natural bias of the seat 12 springing closed.

In some embodiments, one or more additional anchors 16 are provided to attach the device 24 to the seat 22 at one or more additional points. These anchors may include strips, straps, bands, hooks, magnets, zippers, or buttons.

In some embodiments, the size of the seat and back of the device can be adjusted by means of zippers, buttons, clasps, or snaps in order to be made to accommodate the varied sizes of self-folding seats.

Figure 4:
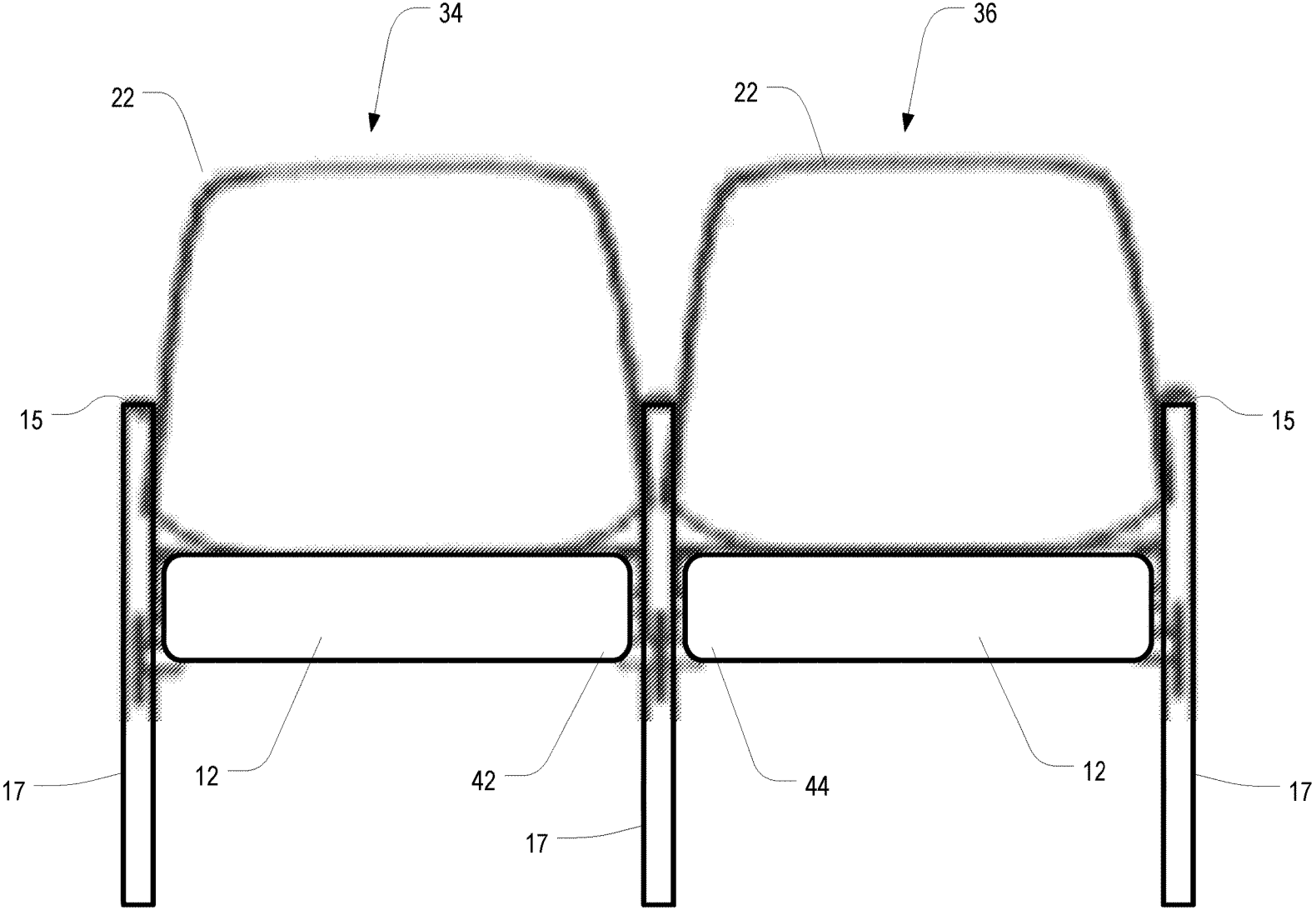
FIG. 4 is a front view of a pair of adjacent seats, one of which is designated as a parent seat and one as a child seat.

In various alternative approaches, a first seat bottom 12 may be anchored to a second seat bottom 12, adjacent to the first, such that operation of the second seat bottom 12 controls operation of the first. In this regard, FIG. 4 is a front view of a pair of adjacent seats 22, one of which is designated as a parent seat 36 and one as a child seat 34. By installing any of various anti-closure devices between the seat portion 12 of the parent seat 36 and the seat portion 12 of the child seat 34, the child seat bottom may be held down (open) so long as the parent seat bottom is held down. Thus, so long as a parent or other heavier user remains seated in the parent seat 36, the seat bottom 12 of the parent seat 36 is held down (open), and the linkage to the seat bottom 12 of the child seat created by the anti-closure device causes the child seat bottom to remain down as well.

Anti-closure devices using various different structures and/or mechanisms may be utilized to create such a linkage. Typically, though not necessarily, such an anti-closure device is attached, connected, or installed between adjacent areas 42,44 on the child seat bottom and the parent seat bottom. In some embodiments the anti-closure device may utilize flexible or rigid components together with screws, springs, clips, magnets, and/or the like to attach to the seat bottoms 12 of the adjacent seats 34,36. Some of these structures and/or mechanisms are described and/or illustrated herein.

Figure 5A:
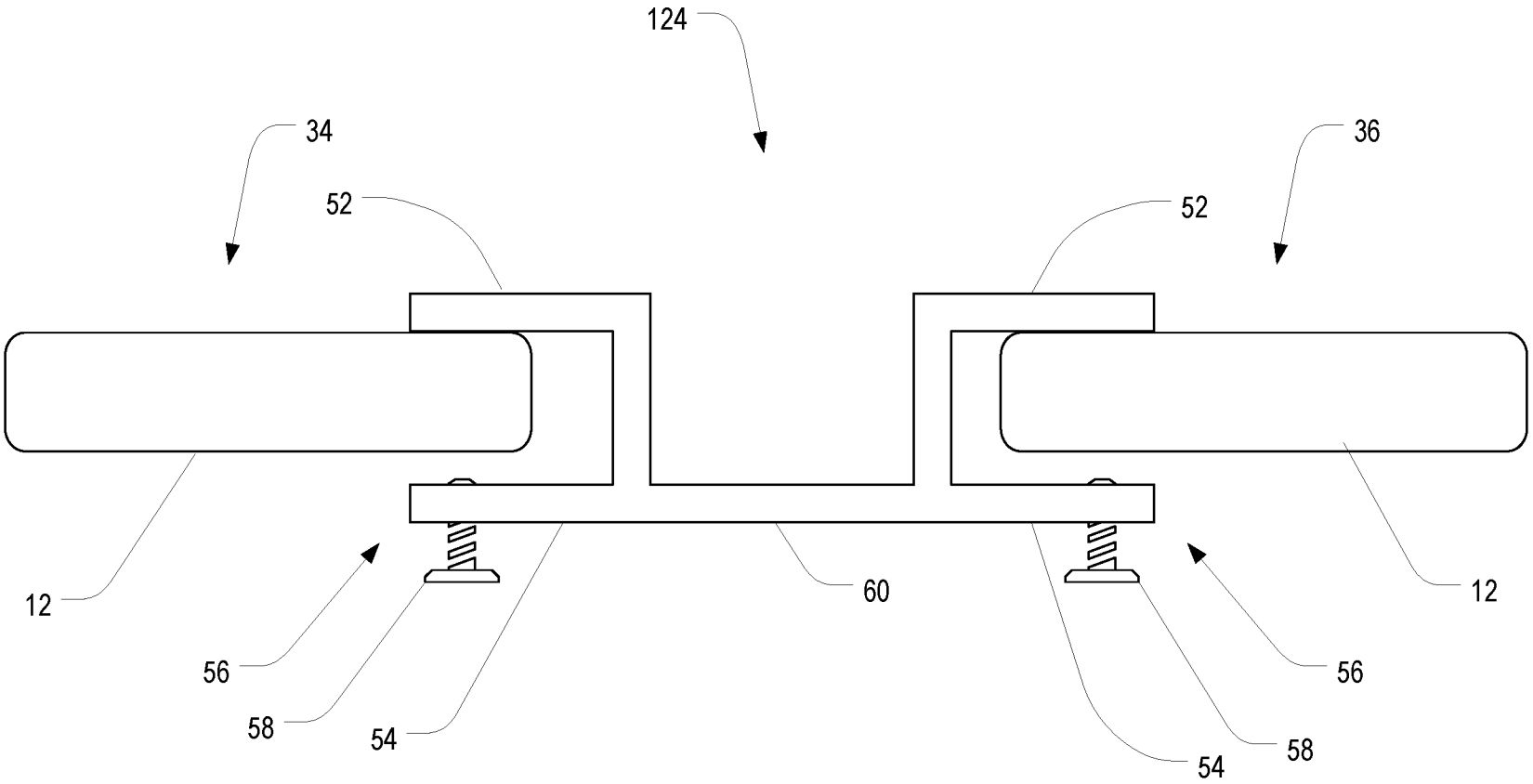
FIGS. 5A and 5B are partially-schematic front views of a second anti-closure device for use with the seat bottoms of a pair of adjacent self-folding seats in accordance with one or more preferred embodiments of the present invention.
Figure 5B:
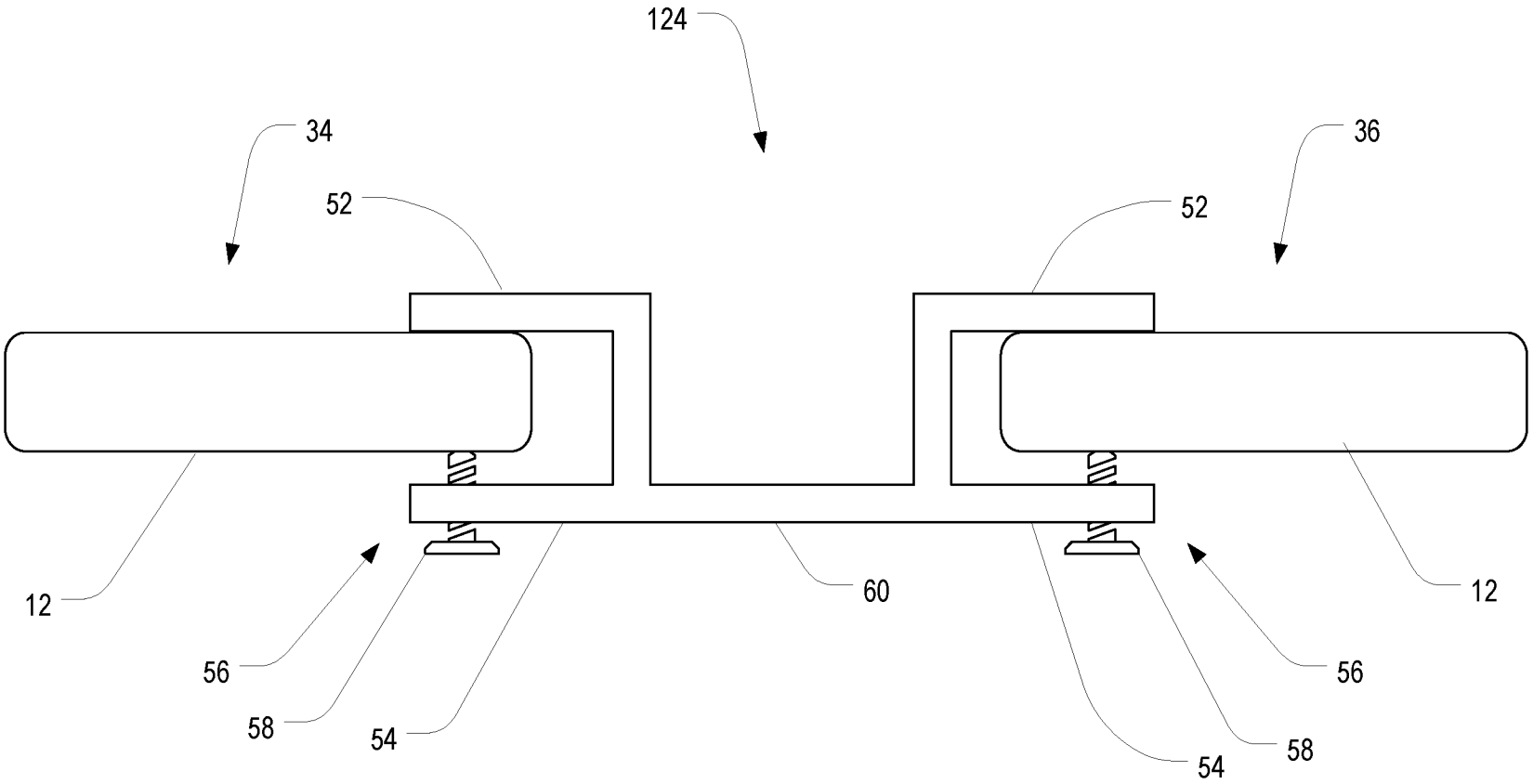

FIGS. 5A and 5B are partially-schematic front views of a second anti-closure device 124 for use with the seat bottoms 12 of a pair of adjacent self-folding seats 34,36 in accordance with one or more preferred embodiments of the present invention. As shown therein, the anti-closure device 124 includes two seat clamps 56 linked by a cross-brace 160. Each seat clamp 56 includes a top clamp face 52 and a bottom clamp face 54. In this embodiment, the top and bottom clamp faces 52,54 are rigid, and an adjustable screw 58 is threaded through the respective bottom clamp face 54 and tightened against the bottom surface of the seat bottom 12 as illustrated in FIG. 5B. When the seat clamps 56 are properly mounted on the seat bottoms 12, the device seat bottom 12 of the child seat 34 is held down by the anti-closure device 124 so long as the seat bottom 12 of the parent seat 36 is held down.

Figure 6A:
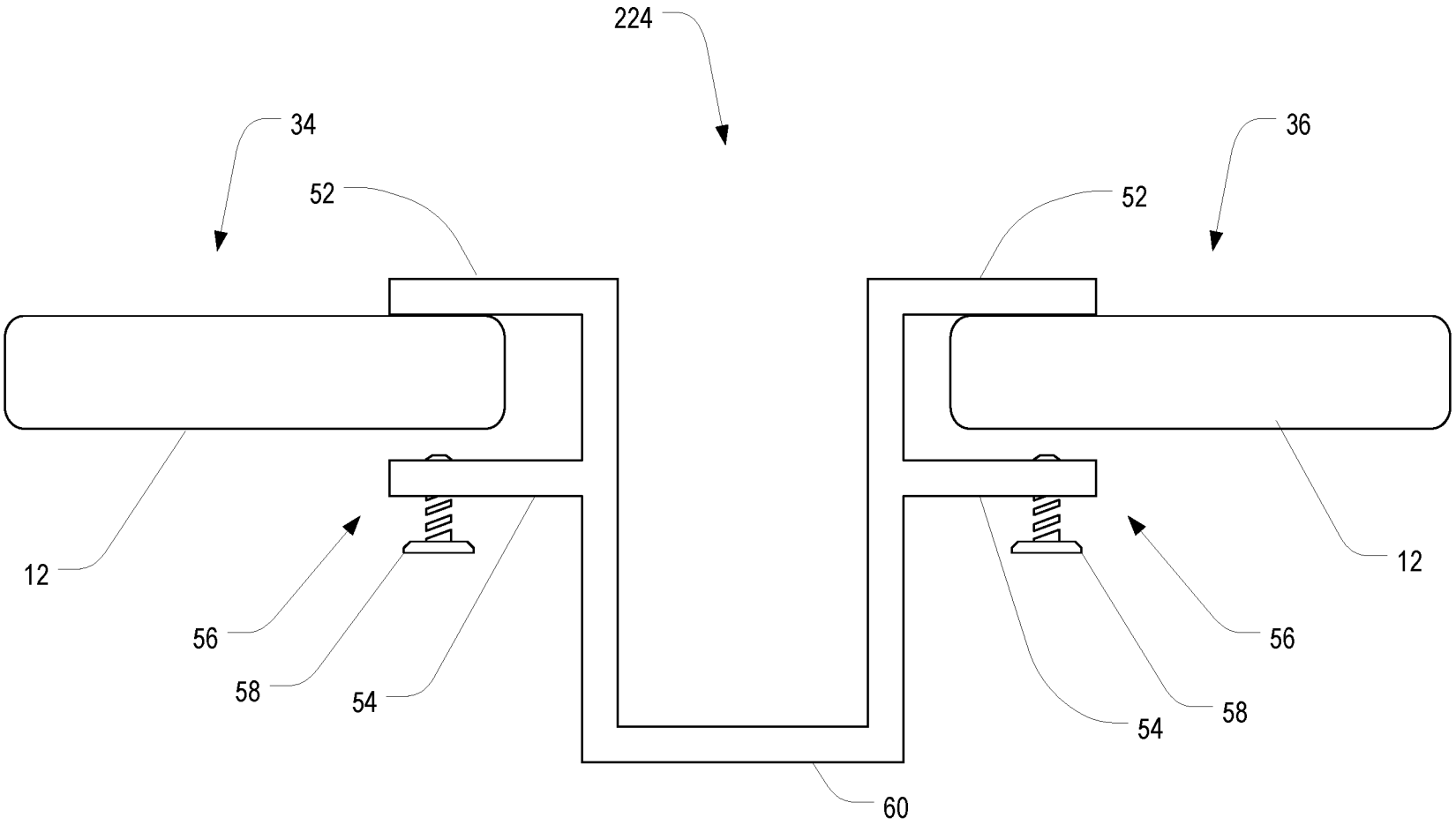
FIGS. 6A and 6B are partially-schematic front views of a third anti-closure device for use with the seat bottoms of a pair of adjacent self-folding seats in accordance with one or more preferred embodiments of the present invention.
Figure 6B:
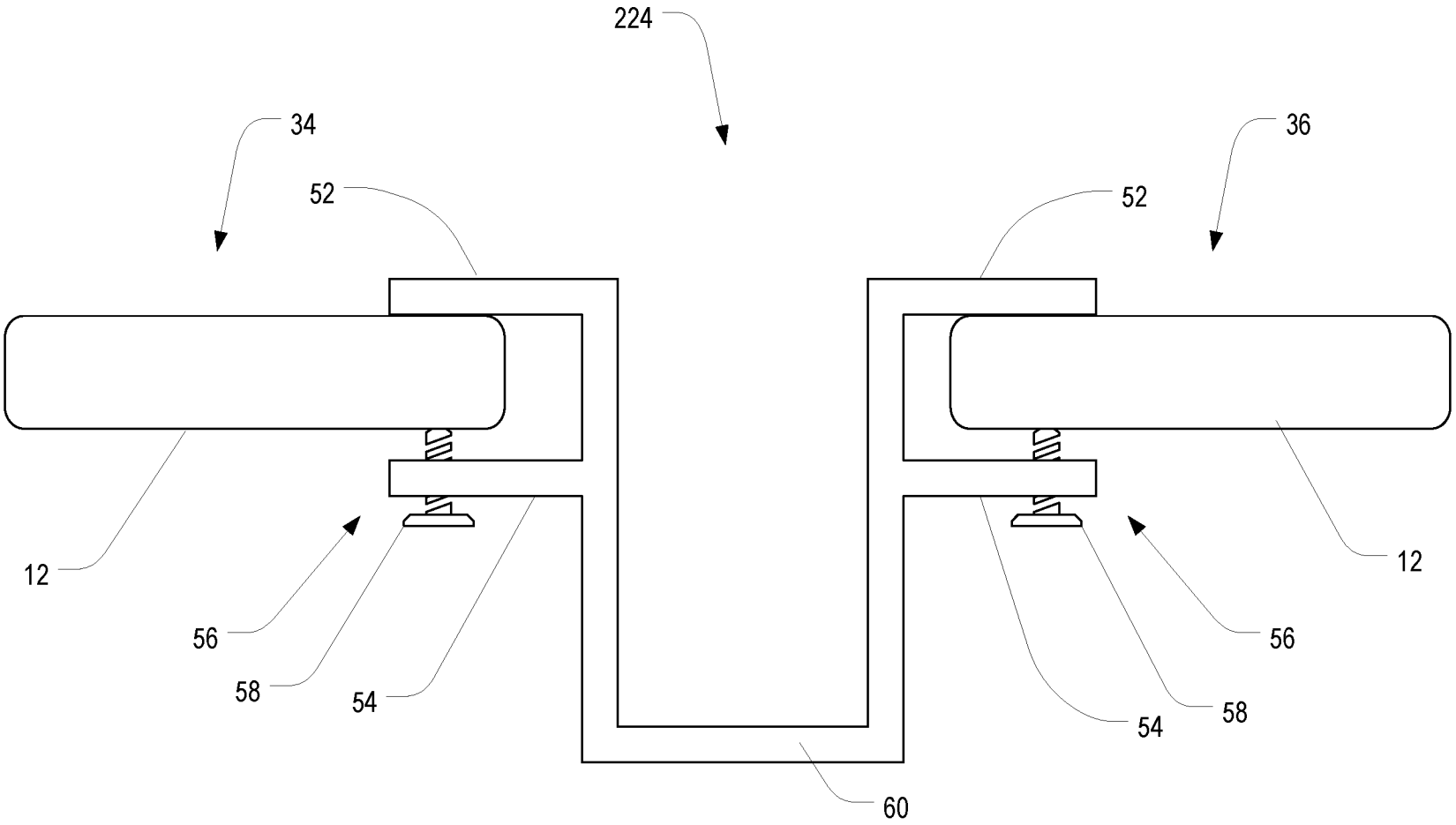

In some embodiments an anti-closure device features geometry to better accommodate the side chair platform 17 between the parent and child seats 36,34. In this regard, FIGS. 6A and 6B are partially-schematic front views of a third anti-closure device 224 for use with the seat bottoms 12 of a pair of adjacent self-folding seats 34,36 in accordance with one or more preferred embodiments of the present invention. As shown therein, the anti-closure device 224 includes two seat clamps 56 linked by a modified cross-brace 260. As with the device of FIGS. 5A and 5B, each seat clamp 56 includes a top clamp face 52 and a bottom clamp face 54. In this embodiment, the top and bottom clamp faces 52,54 are rigid, and an adjustable screw 58 is threaded through the respective bottom clamp face 54 and tightened against the bottom surface of the seat bottom 12 as illustrated in FIG. 6B. Notably, the modified cross-brace 260 is arranged to fit beneath and/or around the side chair platform 17 between the parent and child seats 36,34.

Figure 7A:
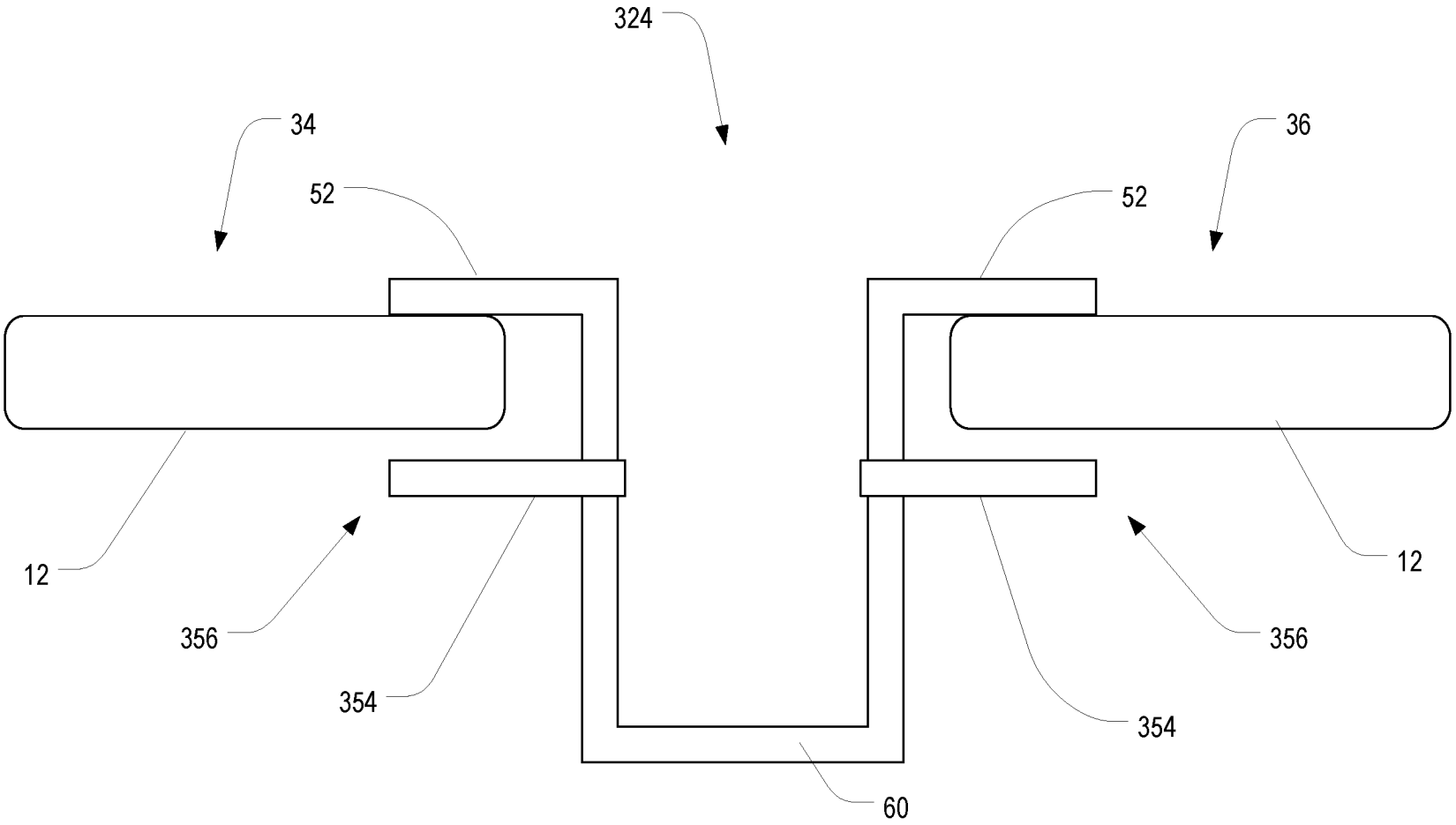
FIGS. 7A and 7B are partially-schematic front views of a fourth anti-closure device for use with the seat bottoms of a pair of adjacent self-folding seats in accordance with one or more preferred embodiments of the present invention.
Figure 7B:
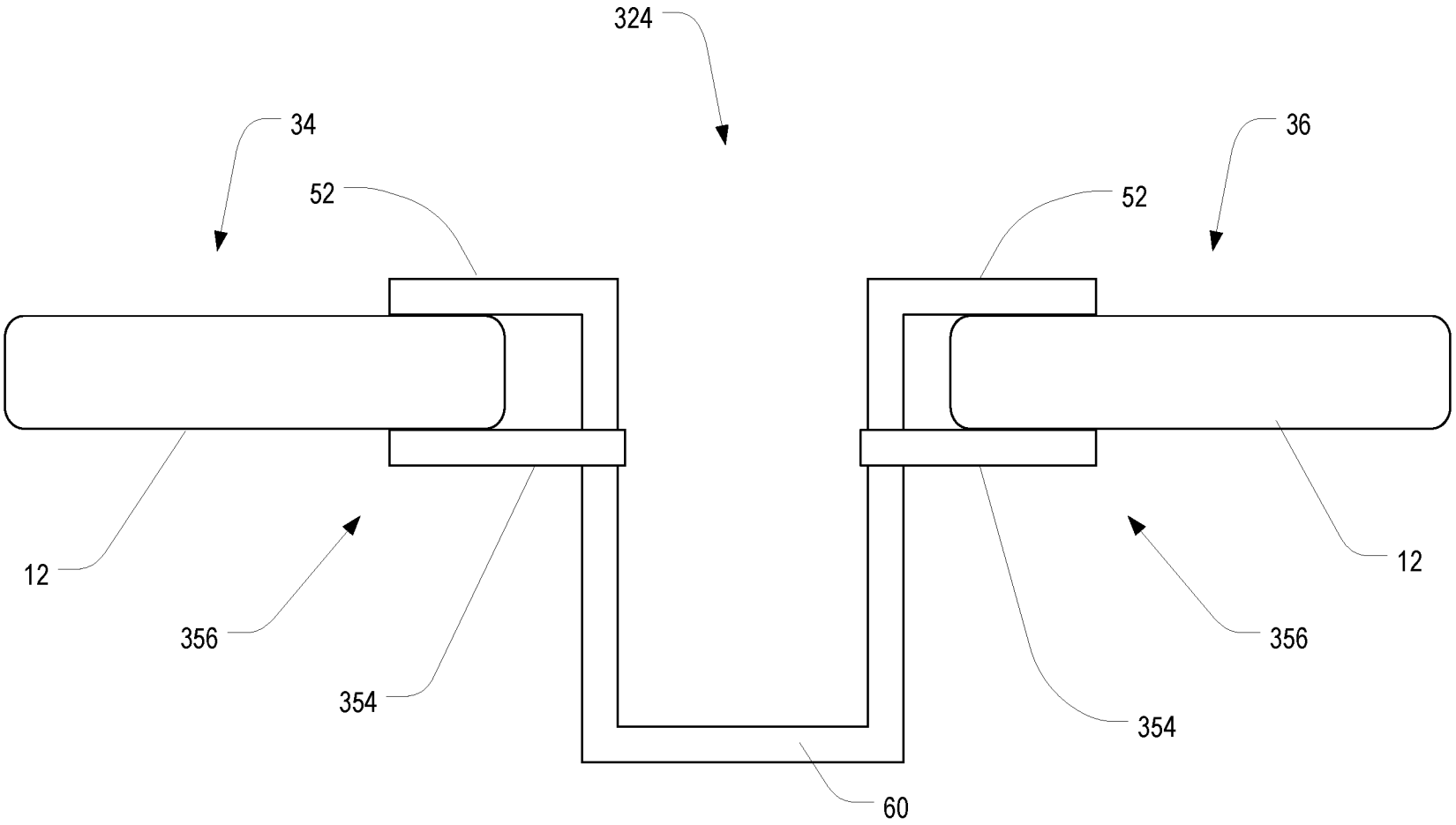

Other clamping mechanisms may alternatively be utilized. In this regard, FIGS. 7A and 7B are partially-schematic front views of a fourth anti-closure device 324 for use with the seat bottoms 12 of a pair of adjacent self-folding seats 34,36 in accordance with one or more preferred embodiments of the present invention. As shown therein, the anti-closure device 324 includes two seat clamps 356 linked by a cross-brace 360. Each seat clamp 356 includes a fixed top clamp face 52 and an adjustable bottom clamp face 354. Each adjustable bottom clamp face 354 may be translated up and down to position it against the bottom of the respective bottom seat 12 as illustrated in FIG. 7B. Various mechanisms may be used to facilitate such translation and positioning such that the clamp 356 is held firmly in place on the seat bottom 12. When the seat clamps 356 are properly mounted on the seat bottoms 12, the device seat bottom 12 of the child seat 34 is held down by the anti-closure device 324 so long as the seat bottom 12 of the parent seat 36 is held down.

Figure 8A:
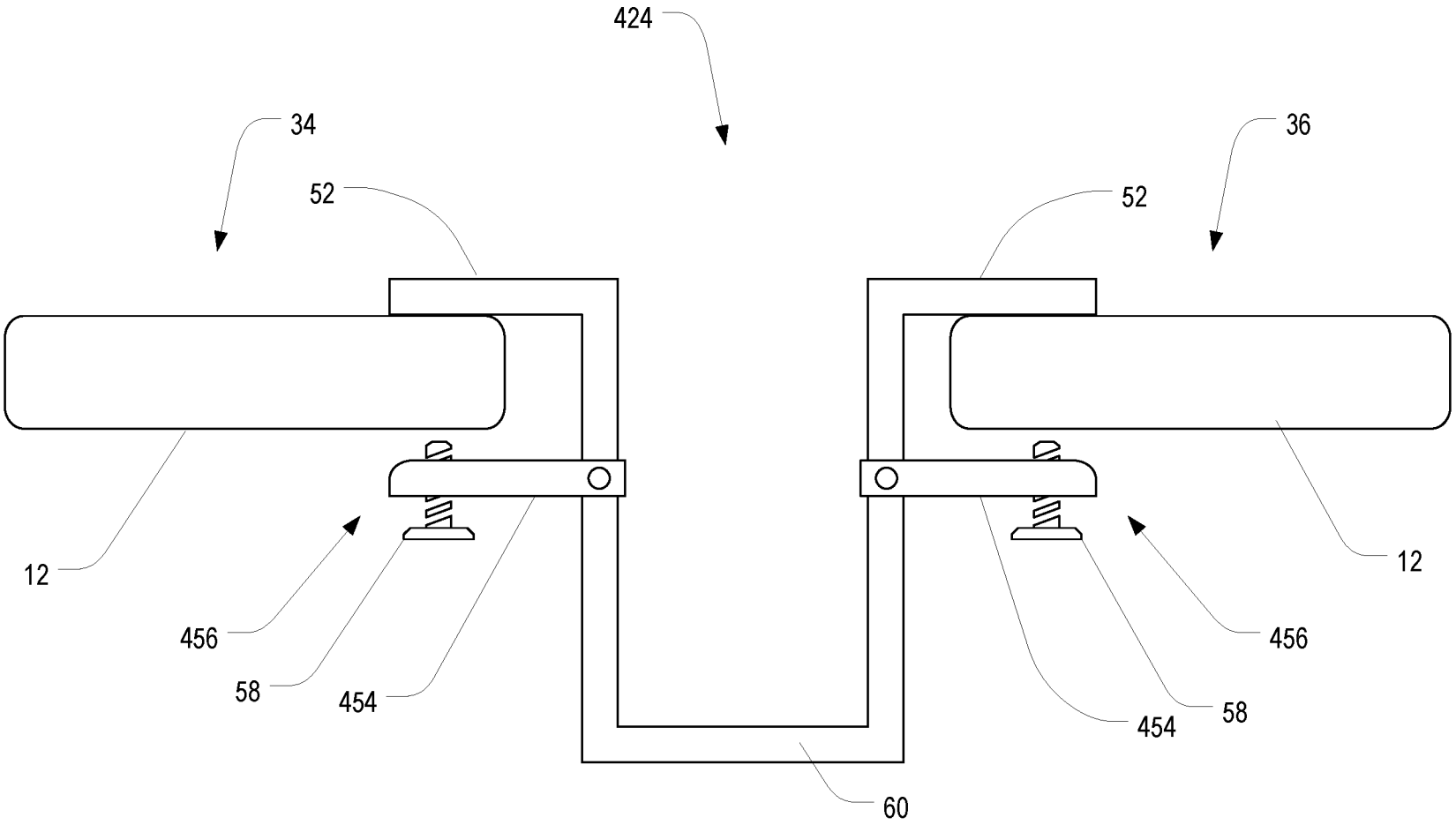
FIGS. 8A and 8B are partially-schematic front views of a fifth anti-closure device for use with the seat bottoms of a pair of adjacent self-folding seats in accordance with one or more preferred embodiments of the present invention.
Figure 8B:
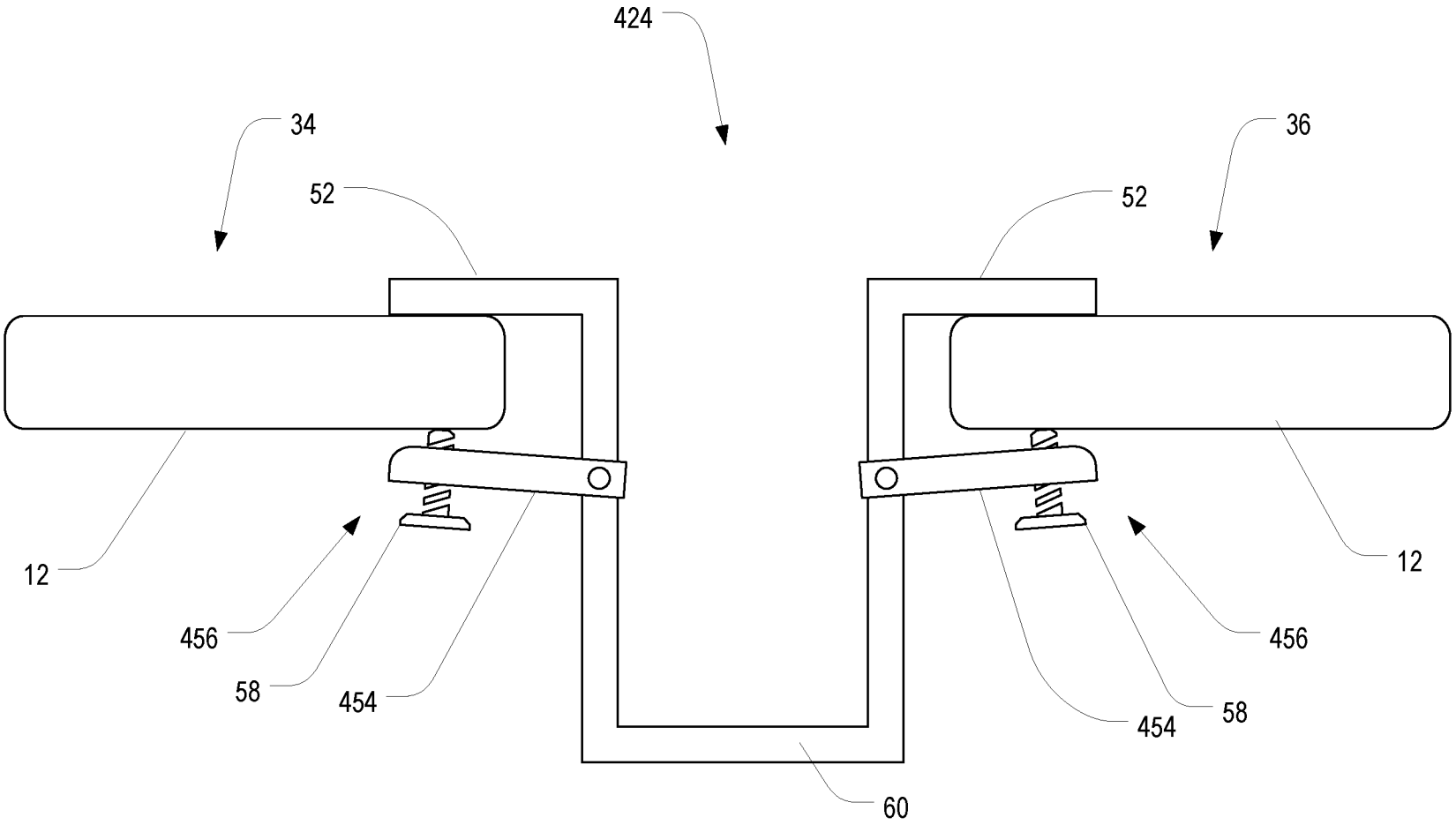

Another clamping mechanism is shown in FIGS. 8A and 8B, which are partially-schematic front views of a fifth anti-closure device 424 for use with the seat bottoms 12 of a pair of adjacent self-folding seats 34,36 in accordance with one or more preferred embodiments of the present invention. As shown therein, the anti-closure device 424 includes two seat clamps 456 linked by a cross-brace 460. Each seat clamp 456 includes a fixed top clamp face 52 and an adjustable bottom clamp face 454. Each adjustable bottom clamp face 454 may be rotated up and down to position it against the bottom of the respective bottom seat 12 as illustrated in FIG. 8B. Various mechanisms may be used to facilitate such rotation and positioning such that the clamp 456 is held firmly in place on the seat bottom 12. When the seat clamps 456 are properly mounted on the seat bottoms 12, the device seat bottom 12 of the child seat 34 is held down by the anti-closure device 424 so long as the seat bottom 12 of the parent seat 36 is held down.

In some embodiments (not illustrated), a cross-brace is provided with suction cups to help retain the cross-brace in place between the adjacent seat bottoms 12. The suction cups may be utilized in conjunction with one of the clamping mechanisms described herein, or in some cases may be utilized by themselves. In at least some embodiments, the suction cups are used by compressing them against bottom surfaces of the seat bottoms 12.

In some embodiments (not illustrated), a cross-brace is provided with magnets to help retain the cross-brace in place between the adjacent seat bottoms 12. The magnets may be utilized in conjunction with one of the clamping mechanisms described herein, or in some cases may be utilized by themselves.

In some embodiments (not illustrated), hardware is permanently or semi-permanently attached to the seat bottoms 12 such that a rigid cross-member may be temporarily attached between adjacent seat bottoms 12. In such arrangements, the rigid member may be provided by a user or may be provided by the venue manager.

Figure 9:
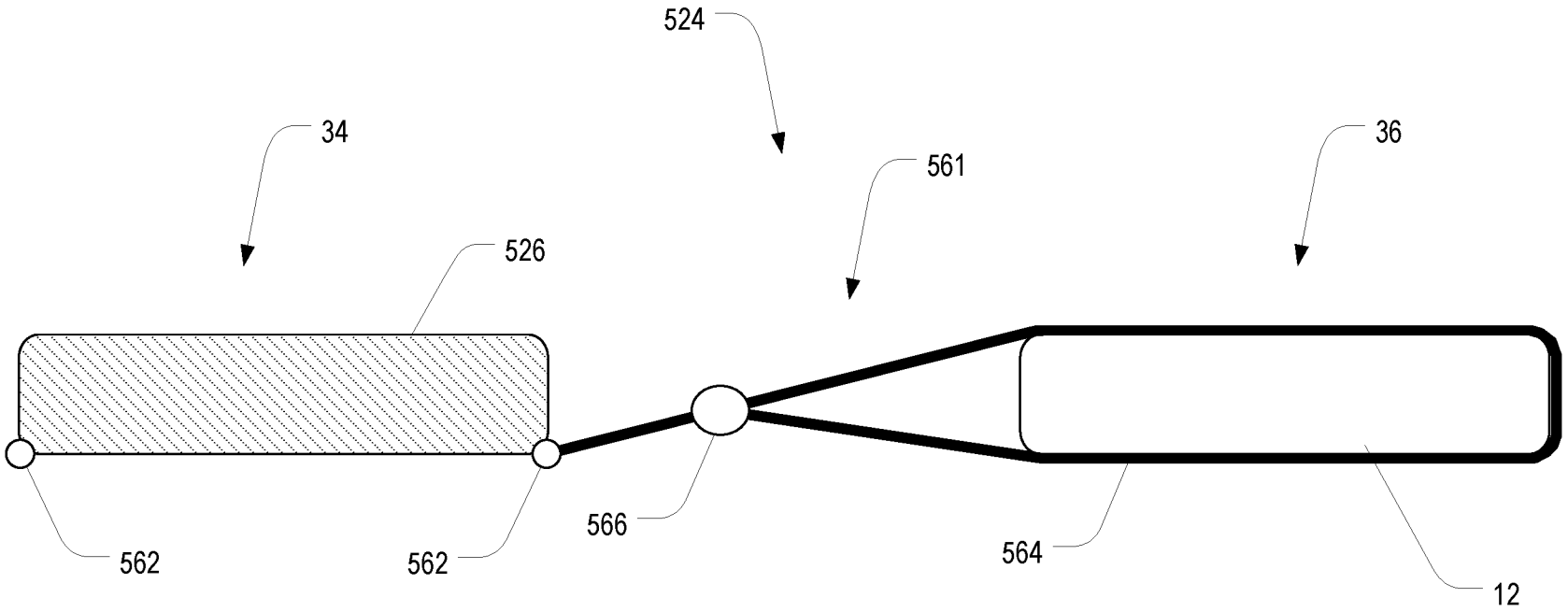
FIG. 9 is a partially-schematic front view of a sixth anti-closure device for use with the seat bottoms of a pair of adjacent self-folding seats in accordance with one or more preferred embodiments of the present invention.

In various further alternative embodiments, an anti-closure device is used to tether the child seat 34 to the parent seat 36. For example, FIG. 9 is a partially-schematic front view of a sixth anti-closure device 524 for use with the seat bottoms 12 of a pair of adjacent self-folding seats 34,36 in accordance with one or more preferred embodiments of the present invention. This anti-closure device 524 includes a seat bottom cover 526 and a tether apparatus 561. The seat bottom cover 526 fits over the seat bottom 12 of one of the seats; in FIG. 9, it is shown installed on the seat bottom 12 of the child seat 34. The tether apparatus 561 includes a strap 564 or the like that is adapted to wrap around the other seat bottom 12; in FIG. 9, it is shown wrapped around the seat bottom of the parent seat 36. The tether apparatus 561 is attached at one end to an attachment point 562 on the seat bottom cover 526 via appropriate attachment means, such as a D-ring held by a reinforcement strap. The attachment point 562 is preferably located at a point on the seat bottom cover 526 that is most proximate to the other seat bottom 12, such as near the front bottom corner of the cover 526; a corresponding attachment point 562 may be provided on the opposite side of the cover 526. In some embodiments, the strap 564 is permanently attached to the seat bottom cover 526; in some embodiments, hardware is provided to permit the strap 564 to be connected and disconnected from the attachment point(s) 562. Tension may be applied to the strap 564 via a buckle 566 or the like.

In use, the seat bottom cover 526 is installed on one seat bottom 12, the strap 564 is wrapped around the other seat bottom 12, and tension is applied to the strap 564 via the buckle 566 or other tensioning device in order to provide constant force. When sufficient tensioning force is applied and maintained, the seat bottom 12 of the child seat 34 is held down by the tether apparatus 561 so long as the seat bottom 12 of the parent seat 36 is held down.

Figure 10:
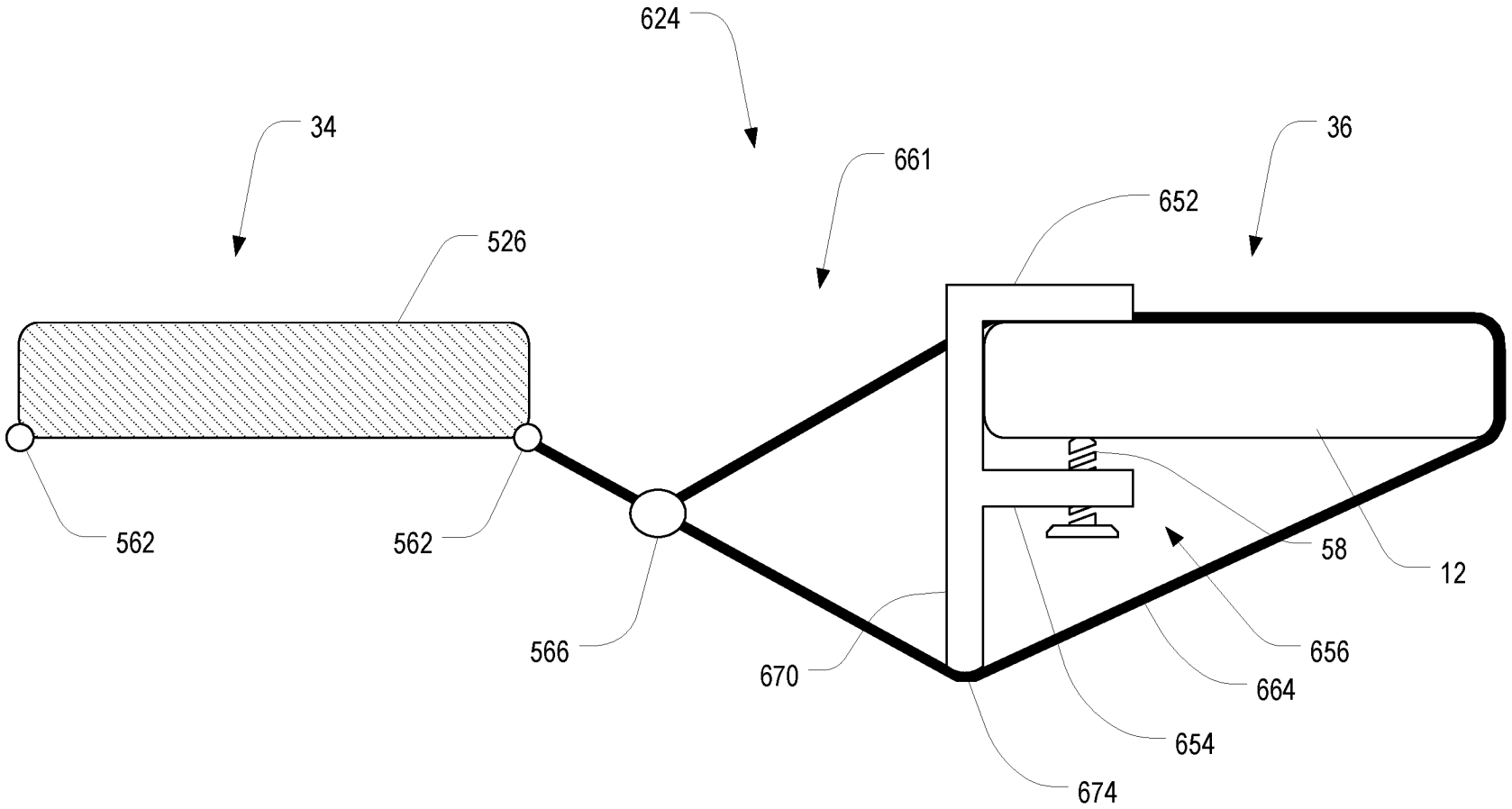
FIG. 10 is a partially-schematic front view of a seventh anti-closure device for use with the seat bottoms of a pair of adjacent self-folding seats in accordance with one or more preferred embodiments of the present invention.

In some embodiments an anti-closure device includes a rigid member that alters the path of the strap after it wraps around the seat bottom to change the angle at which the strap applies tension to the other seat bottom. In this regard, FIG. 10 is a partially-schematic front view of a seventh anti-closure device 624 for use with the seat bottoms 12 of a pair of adjacent self-folding seats 34,36 in accordance with one or more preferred embodiments of the present invention. This anti-closure device 624 includes a seat bottom cover 526, a tether apparatus 661, and a strap bracket 670. The seat bottom cover 526 fits over the seat bottom 12 of one of the seats; in FIG. 10, it is shown installed on the seat bottom 12 of the child seat 34. The tether apparatus 661 includes a strap 664 or the like that is adapted to wrap around the other seat bottom 12; in FIG. 10, it is shown wrapped around the seat bottom of the parent seat 36. The tether apparatus 661 is attached at one end to an attachment point 562 on the seat bottom cover 526 via appropriate attachment means, such as a D-ring held by a reinforcement strap. The attachment point 562 is preferably located at a point on the seat bottom cover 526 that is most proximate to the other seat bottom 12, such as near the front bottom corner of the cover 526; a corresponding attachment point 562 may be provided on the opposite side of the cover 526. In some embodiments, the strap 664 is permanently attached to the seat bottom cover 526; in some embodiments, hardware is provided to permit the strap 664 to be connected and disconnected from the attachment point(s) 562. Tension may be applied to the strap 664 via a buckle 566 or the like.

The strap bracket 670 includes a seat clamp 656 and a strap point 674. The seat clamp 656 includes a top clamp face 652 and a bottom clamp face 654. In this embodiment, the top and bottom clamp faces 652,654 are rigid, and an adjustable screw 58 is threaded through the bottom clamp face 654 and tightened against the bottom surface of the seat bottom 12 as illustrated in FIG. 10. When the seat clamp 656 is properly mounted on the seat bottom 12, the strap point 674 is disposed away from the seat bottom 12, thereby redirecting the path of the strap 664 as shown in FIG. 10.

In use, the seat bottom cover 526 is installed on one seat bottom 12, the strap 664 is wrapped around the other seat bottom 12, and tension is applied to the strap 664 via the buckle 666 or other tensioning device in order to provide constant force. When sufficient tensioning force is applied and maintained, the seat bottom 12 of the child seat 34 is held down by the tether apparatus 661 so long as the seat bottom 12 of the parent seat 36 is held down.

Figure 11:
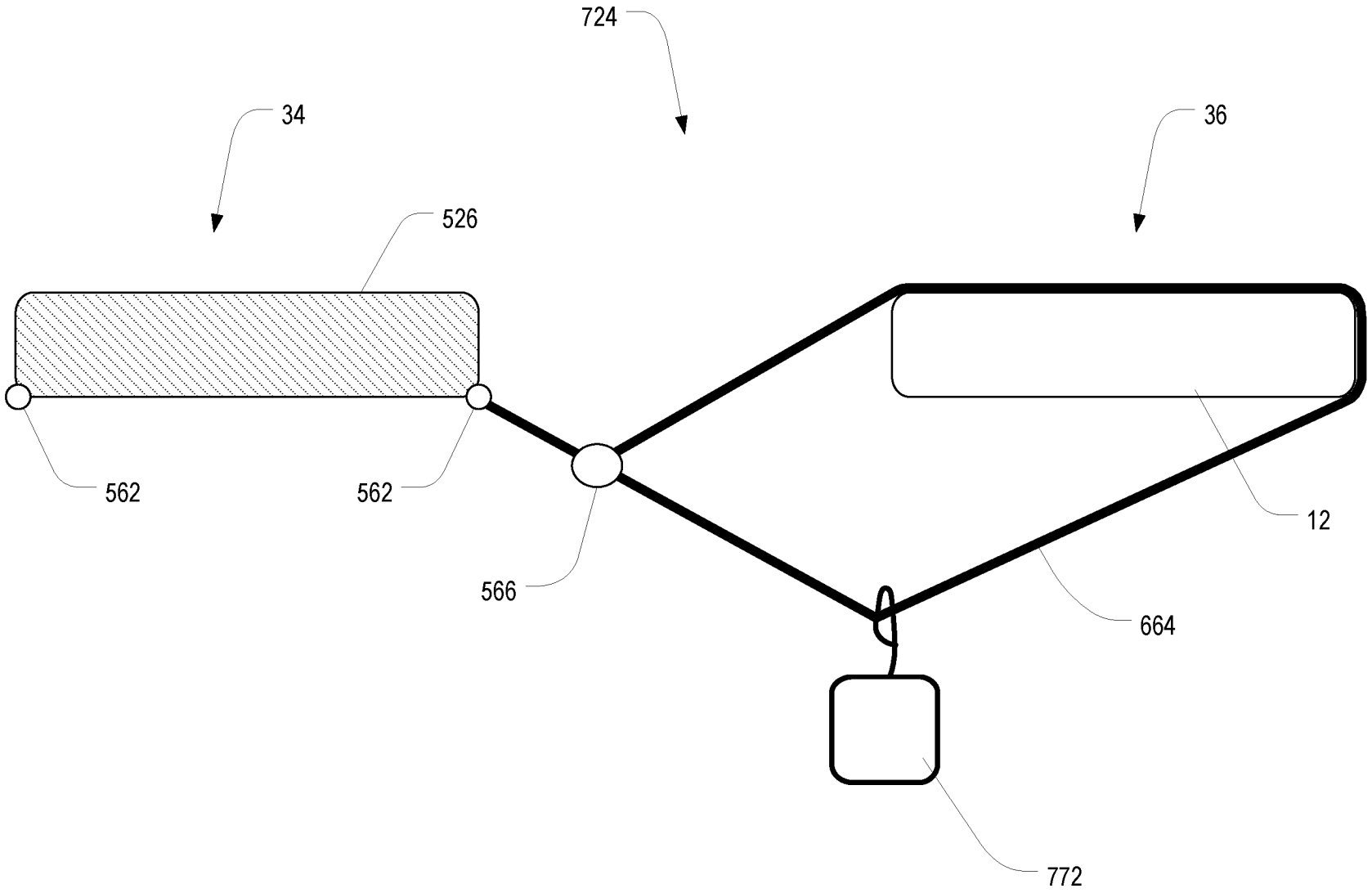
FIG. 11 is a partially-schematic front view of an eighth anti-closure device for use with the seat bottoms of a pair of adjacent self-folding seats in accordance with one or more preferred embodiments of the present invention.

In some embodiments the rigid member may be replaced by a suspended mass 72 that provides a function similar to that of the rigid member by altering the path of the strap 64. In this regard, FIG. 11 is a partially-schematic front view of an eighth anti-closure device 724 for use with the seat bottoms 12 of a pair of adjacent self-folding seats 34,36 in accordance with one or more preferred embodiments of the present invention. This anti-closure device 724 includes a seat bottom cover 526, a tether apparatus 661, and a weight 772. The seat bottom cover 526 fits over the seat bottom 12 of one of the seats; in FIG. 11, it is shown installed on the seat bottom 12 of the child seat 34. The tether apparatus 661 includes a strap 664 or the like that is adapted to wrap around the other seat bottom 12; in FIG. 11, it is shown wrapped around the seat bottom of the parent seat 36. The tether apparatus 661 is attached at one end to an attachment point 562 on the seat bottom cover 526 via appropriate attachment means, such as a D-ring held by a reinforcement strap. The attachment point 562 is preferably located at a point on the seat bottom cover 526 that is most proximate to the other seat bottom 12, such as near the front bottom corner of the cover 526; a corresponding attachment point 562 may be provided on the opposite side of the cover 526. In some embodiments, the strap 664 is permanently attached to the seat bottom cover 526; in some embodiments, hardware is provided to permit the strap 664 to be connected and disconnected from the attachment point(s) 562. Tension may be applied to the strap 664 via a buckle 566 or the like. The weight 772 may be permanently attached to the strap 664, or hardware may be provided to permit the weight to be connected and disconnected from the strap 664.

In use, the seat bottom cover 526 is installed on one seat bottom 12, the strap 664 is wrapped around the other seat bottom 12, and tension is applied to the strap 664 via the buckle 666 or other tensioning device in order to provide constant force. When the weight 772 is hung from the strap 664, the seat bottom 12 of the child seat 34 is held down by the tether apparatus 661 so long as the seat bottom 12 of the parent seat 36 is held down.

Figure 12A:
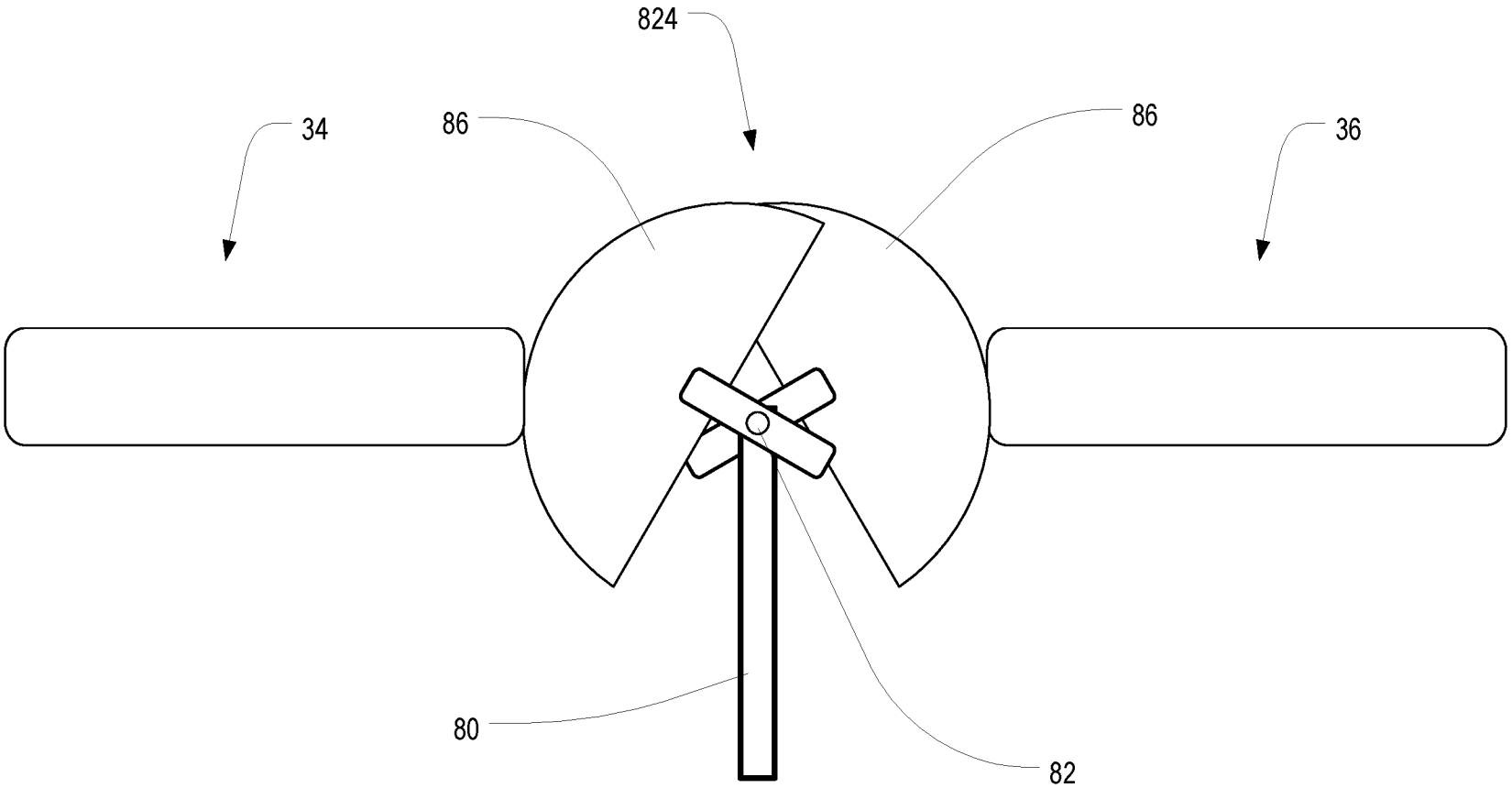
FIGS. 12A and 12B are partially-schematic front views of a ninth anti-closure device for use with the seat bottoms of a pair of adjacent self-folding seats in accordance with one or more preferred embodiments of the present invention.
Figure 12B:
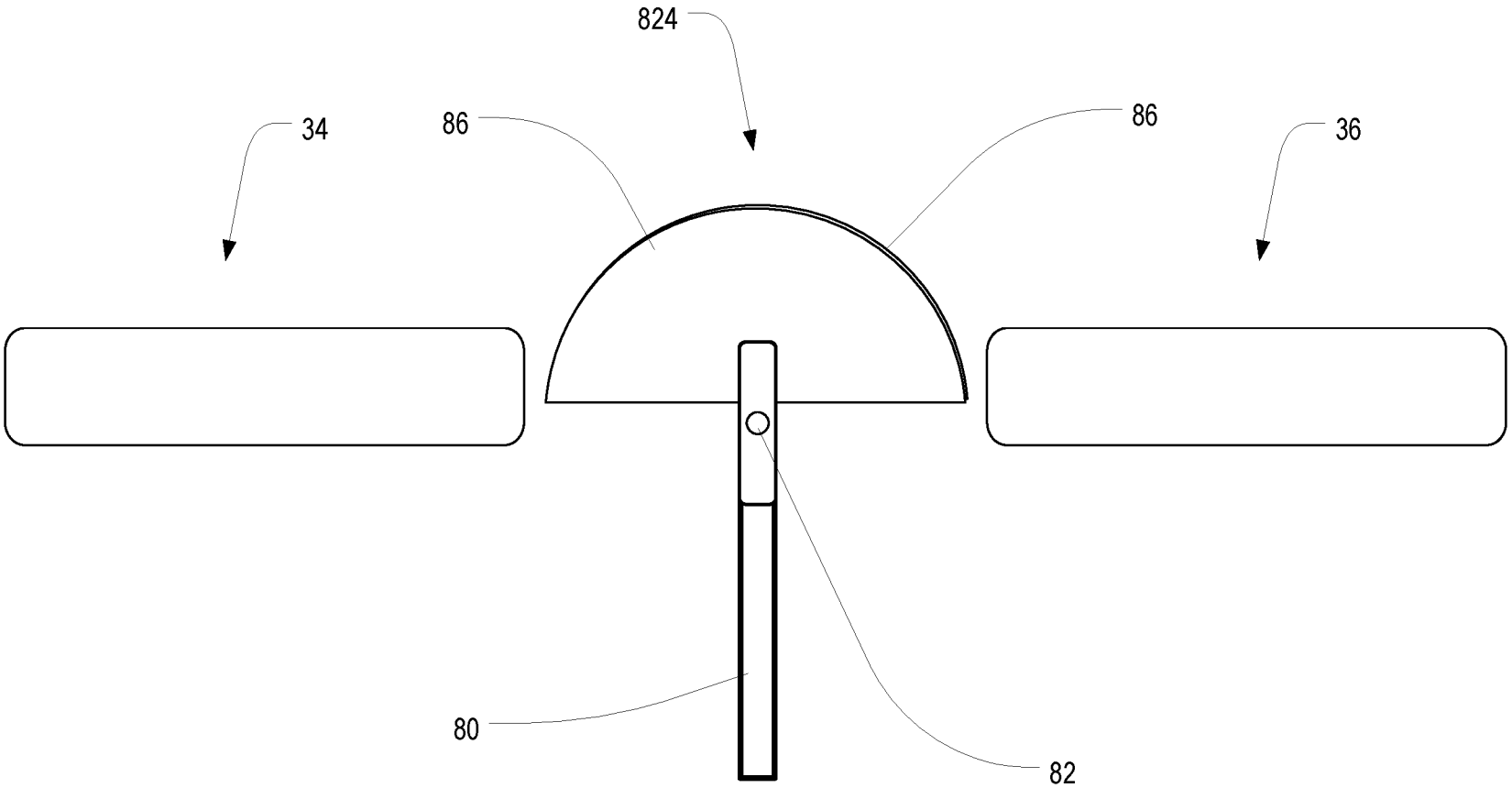

FIGS. 12A and 12B are partially-schematic front views of a ninth anti-closure device 824 for use with the seat bottoms 12 of a pair of adjacent self-folding seats 34,36 in accordance with one or more preferred embodiments of the present invention. As shown therein, a pair of opposing cams 86 that are biased to rotate away from each other will have a generally curved surface directly contacting the edge of the parent 36 and child seat 34, as shown in FIG. 12A. The contact faces, which may include teeth, notches, or the like to improve grip, impart sufficient friction on the seat bottoms 12 to firmly couple them therebetween. An actuator 80 is used to rotate the cams about their axes 82 and align them in a central position, shown in FIG. 12B, allowing the pair of cams to fit in between the seat bottoms 12 of the child and parent seats 34,36 to allow for installation and removal. When the actuator is released the cams will return to their position biased in opposite rotations from one another. In at least some embodiments, such a device may be modeled on rock climbing cam anchors.

In some embodiments the seat will automatically return to the folded or stored position when the child and parent leave their seat.

In some embodiments, a harness system (not illustrated) may be included to allow younger users to safely interact with the seat.

When use is complete, the device can be easily uninstalled by the user in generally opposite manner to the installation.

Based on the foregoing information, it will be readily understood by those persons skilled in the art that the present invention is susceptible of broad utility and application. Many embodiments and adaptations of the present invention other than those specifically described herein, as well as many variations, modifications, and equivalent arrangements, will be apparent from or reasonably suggested by the present invention and the foregoing descriptions thereof, without departing from the substance or scope of the present invention.

Accordingly, while the present invention has been described herein in detail in relation to one or more preferred embodiments, it is to be understood that this disclosure is only illustrative and exemplary of the present invention and is made merely for the purpose of providing a full and enabling disclosure of the invention. The foregoing disclosure is not intended to be construed to limit the present invention or otherwise exclude any such other embodiments, adaptations, variations, modifications or equivalent arrangements; the present invention being limited only by the claim(s) appended hereto and the equivalents thereof.

What is claimed is:

1. An anti-closure device for use with self-folding seats, comprising:

a first attachment portion that is adapted to be removably coupled to a first seat bottom of a first self-folding seat;

a second attachment portion that is adapted to be removably coupled to a second seat bottom of a second self-folding seat, the second seat being adjacent to the first; and a tensioning system attached at a first end to the first attachment portion and at a second end to the second attachment portion;

wherein, when installed on the first and second self-folding seats, the tensioning system maintains force against a natural bias of the seat bottom of the first self-folding seat to fold closed, thereby holding the first seat bottom in an open state.

2. The anti-closure device of claim 1, wherein the first and second seat bottoms are connected by a strap or rope that wraps around a front of the first self-folding seat.

3. The anti-closure device of claim 1, wherein the first and second seat bottoms are connected by a strap or rope that wraps around a front of the second self-folding seat.

4. The anti-closure device of claim 1, wherein the tensioning system includes a rigid member, wherein the first attachment portion includes a clamp that is removably coupled to the first seat bottom, and wherein the first attachment portion includes a strap or rope connected to the first self-folding seat and/or a seat cover on the first self-folding seat.

5. The anti-closure device of claim 1, wherein the tensioning system includes a rigid member, wherein the second attachment portion includes a clamp that is removably coupled to the second seat bottom, and wherein the first attachment portion includes a strap or rope connected to the first self-folding seat and/or a seat cover on the first self-folding seat.

6. The anti-closure device of claim 1, wherein the first and second seat bottoms are connected by a strap or rope, and wherein the device further includes a counterweight hanging from the strap or rope.

7. The anti-closure device of claim 1, wherein the tensioning system includes a strap or rope.

8. The anti-closure device of claim 7, wherein the first attachment portion includes a strap or rope that wraps around the first self-folding seat bottom.

9. The anti-closure device of claim 7, wherein the second attachment portion includes a strap or rope that wraps around the second self-folding seat bottom.

10. The anti-closure device of claim 7, wherein the first attachment portion includes a seat cover on the first self-folding seat bottom.

11. The anti-closure device of claim 7, wherein the second attachment portion includes a seat cover on the second self-folding seat bottom.

12. The anti-closure device of claim 1, wherein the tensioning system includes a buckle to apply tension to the strap or rope.

13. An anti-closure device for use with self-folding seats, comprising:

a first attachment portion that is adapted to be removably coupled to a first seat bottom of a first self-folding seat;

a second attachment portion that is adapted to be removably coupled to a second seat bottom of a second self-folding seat, the second seat being adjacent to the first; and a linkage, connected between the first and second attachment portions to connect the first seat bottom to the second seat bottom;

wherein, when installed on the first and second self-folding seats, force produced by the weight of a person seated in the second seat bottom is transferred to the first seat bottom and maintained against a natural bias of the seat bottom of the first self-folding seat bottom to fold closed, thereby holding the first seat bottom in an open state.

14. The anti-closure device of claim 13, wherein the first and second seat bottoms are connected by a strap or rope that wraps around a front of the second self-folding seat.

15. The anti-closure device of claim 13, wherein the linkage includes a rigid member, wherein the second attachment portion includes a clamp that is removably coupled to the second seat bottom, and wherein the first attachment portion includes a strap or rope connected to the first self-folding seat and/or a seat cover on the first self-folding seat.

16. The anti-closure device of claim 13, wherein the linkage includes a rigid member, wherein the first and second attachment portions each include a magnet, and wherein the magnets are each removably coupled to a respective seat bottom.

17. The anti-closure device of claim 13, wherein the first and second seat bottoms are connected by a strap or rope, and wherein the device further includes a counterweight hanging from the strap or rope.

18. The anti-closure device of claim 13, wherein the self-folding seats include a structural member interposed therebetween, wherein the linkage includes a rigid member, and wherein the rigid member is nonlinear so as to fit around the structural member.

* * * * *